United States Patent [19]

Nagata et al.

[11] Patent Number: 5,051,547

[45] Date of Patent: Sep. 24, 1991

[54] SWITCH MECHANISM FOR AN ELECTRIC POWER TOOL

[75] Inventors: Kunio Nagata, Otokuni; Masatsugu Yamashita, Neyagawa, both of Japan

[73] Assignee: Omron Corporation, Kyoto, Japan

[21] Appl. No.: 454,291

[22] Filed: Dec. 22, 1989

[30] Foreign Application Priority Data

Dec. 23, 1988 [JP] Japan ..... 63-326439
May 24, 1989 [JP] Japan ..... 1-131206
May 26, 1989 [JP] Japan ..... 1-134269

[51] Int. Cl.[5] ..... H01H 9/00
[52] U.S. Cl. ..... 200/1 V
[58] Field of Search ..... 200/1 R, 1 V, 5 R, 16 C, 200/16 D, 17 R, 18, 302.1; 388/827, 840, 851, 859, 860, 937

[56] References Cited

U.S. PATENT DOCUMENTS 4,847,451 7/1989 Nagata ..... 200/1 V
4,903,318 2/1990 Nagata ..... 200/1 V X

*Primary Examiner*—J. R. Scott
*Attorney, Agent, or Firm*—Fish & Richardson

[57] ABSTRACT

A switch mechanism for an electric power tool, comprising: a linear slider received in a switch case so as to be moved manually in a first direction against the biasing force of a return spring; an actuating pin carried by the linear slider so as to be moveable along a second direction perpendicular to the first direction; a pair of direction converting levers crossed in the manner of a pair of scissors by a pivot pin mounted on the switch case, the actuating pin being located adjacent to first ends of the direction converting levers; a pair of lateral sliders engaged by second ends of the direction converting levers and allowed to move in the second direction; a first contact set including contacts carried by the linear slider and the wall surface of the switch case for mutual cooperation as the linear slider is moved in the first direction; and a second contact set including contacts carried by the lateral sliders and the wall surface of the switch case for mutual cooperation as the lateral sliders are moved in the second direction; the actuating pins being moveable between the first ends of the direction converting levers so as to selectively actuate one of the direction converting levers and the associated one of the lateral sliders through movement of the linear slider along the first direction via an engagement between the actuating pin and the first end of the associated one of the direction converting levers.

6 Claims, 5 Drawing Sheets

SWITCH MECHANISM FOR AN ELECTRIC POWER TOOL

TECHNICAL FIELD

The present invention relates to a switch for turning on and off power and reversing the rotational direction of electric power tools such as electric screw drivers and electric drills, and in particular to such a switch for electric power tools which is simplified in structure.

BACKGROUND OF THE INVENTION

Conventionally, a switch for power tools of this kind is provided with several separate contact units for turning on and off power, speed control, and reversing the rotational direction of the motor by switching over the polarity of the motor, for instance, as shown in Japanese patent application No. 62-288228.

However, according to such contact units, each contact unit must be provided with a separated return spring for its moveable contact piece, and the resulting increase in the number of component parts presented a major difficulty in simplifying the construction and assembly of the switch.

Further, since operation of the reversion switch over lever was carried out without producing any feel, the operator was prone to have doubt as to the accuracy of operation, and it has been desired to improve the tactile feel of its operation in order to improve the operability and reliability of the switch.

BRIEF SUMMARY OF THE INVENTION

A primary object of the present invention is to provide a switch mechanism for electric power tools which is made simple in structure and easy to assemble through reduction in the number of component parts.

A second object of the present invention is to provide a switch mechanism for an electric power tool in which the return spring for the linear slider is additionally utilized for giving a tactile feel to the operation of the reversion switch over lever.

These and other objects of the present invention can be accomplished by providing a switch mechanism for an electric power tool, including: a linear slider received in a switch case so as to be slidable in a first direction along a wall surface of the switch case; a return spring for urging the linear slider in the first direction; manual actuating means for manually moving the linear slider against a spring force of the return spring; an actuating pin carried by the linear slider so as to be moveable along a second direction perpendicular to the first direction; a pair of direction converting levers crossed in the manner of a pair of scissors by a pivot pin mounted on the switch case, the actuating pin being located adjacent to first ends of the direction converting levers; a pair of lateral sliders engaged by second ends of the direction converting levers and allowed to move in the second direction along a wall surface of the switch case; a first contact set including contacts carried by the linear slider and the wall surface of the switch case for mutual cooperation as the linear slider is moved in the first direction; and a second contact set including contacts carried by the lateral slider and the wall surface of the switch case for mutual cooperation as the lateral sliders are moved in the second direction; the actuating pins being moveable between the first ends of the direction converting levers so as to selectively actuate one of the direction converting levers and the associated one of the lateral sliders through movement of the linear slider along the first direction via an engagement between the actuating pin and the first end of the associated one of the direction converting levers. Typically, the engagement between each of the lateral sliders and the second end of the associated one of the direction converting levers consists of an engagement between a slot and a pin.

According to the above described structure, the switching operation of the motor is carried out by depressing a linear slider which may be provided with an actuating shaft projecting forward from the switch case under a biasing force so as to have the contact carried by the linear slider cooperate with a fixed contact for switching operation, and a fine adjustment of the motor output may be carried out in an early part of the depressing movement by laterally moving one of the lateral sliders engaging with either one of a pair of direction converting levers so as to have the contact carried by the applicable lateral slider cooperate with a fixed contact for power and direction control.

Thus, since the lateral sliders may be moved laterally in synchronism with an early part of the sliding movement of the linear slider, and the switch-overs of the two sliders can be carried out in mutual synchronism as the linear slider is moved, it is possible to eliminate the need for a return spring for the lateral sliders. As a result, a significant reduction in the number of component parts simplification of the structure and facilitation of the assembly work can be achieved.

Preferably, the first contact set comprises contacts for selecting between full power and partial power of an electric motor, and the contact set comprises contacts for turning on power for the motor and switching over the rotational direction of the motor.

According to a particularly preferred embodiment of the present invention, a detent means is provided between the actuating pin and the linear slider in order to produce a tactile feel when operating the actuating pin. Preferably, the detent means comprises a slot for receiving the actuating pin so as to permit its movement in the second direction, a detent member received in a hole communicating with the slot so as to abut the actuating pin at its one end and receive a biasing force from the return spring for the linear slider at its other end, the actuating pin encountering an elastic resistance as it is moved along the slot and rides over the other end of the detent member.

When the reversion switch over lever is operated, the actuating pin cooperating therewith is temporarily engaged by the biasing force tactile piece, and the reversion switch over lever is laterally moved against pressure from the biasing force tactile feel piece thereby creating a sudden change in the biasing force and the resistance on the lever, so a clear tactile feel is transmitted to the lever.

Thus, since the operator of the reversion switch over lever can clearly recognize the execution of the switch over from this tactile feel, the operability and reliability of the reversion switch over lever can be improved.

Further, in this tactile feel creating structure, since the return spring for the linear slider also serves as the biasing force tactile feel piece and an economy of component parts can be achieved without requiring any additional elastic member for producing such a tactile feel, it is possible to achieve reduction in the number of component parts and improvement in the operability of the switch at the same time.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
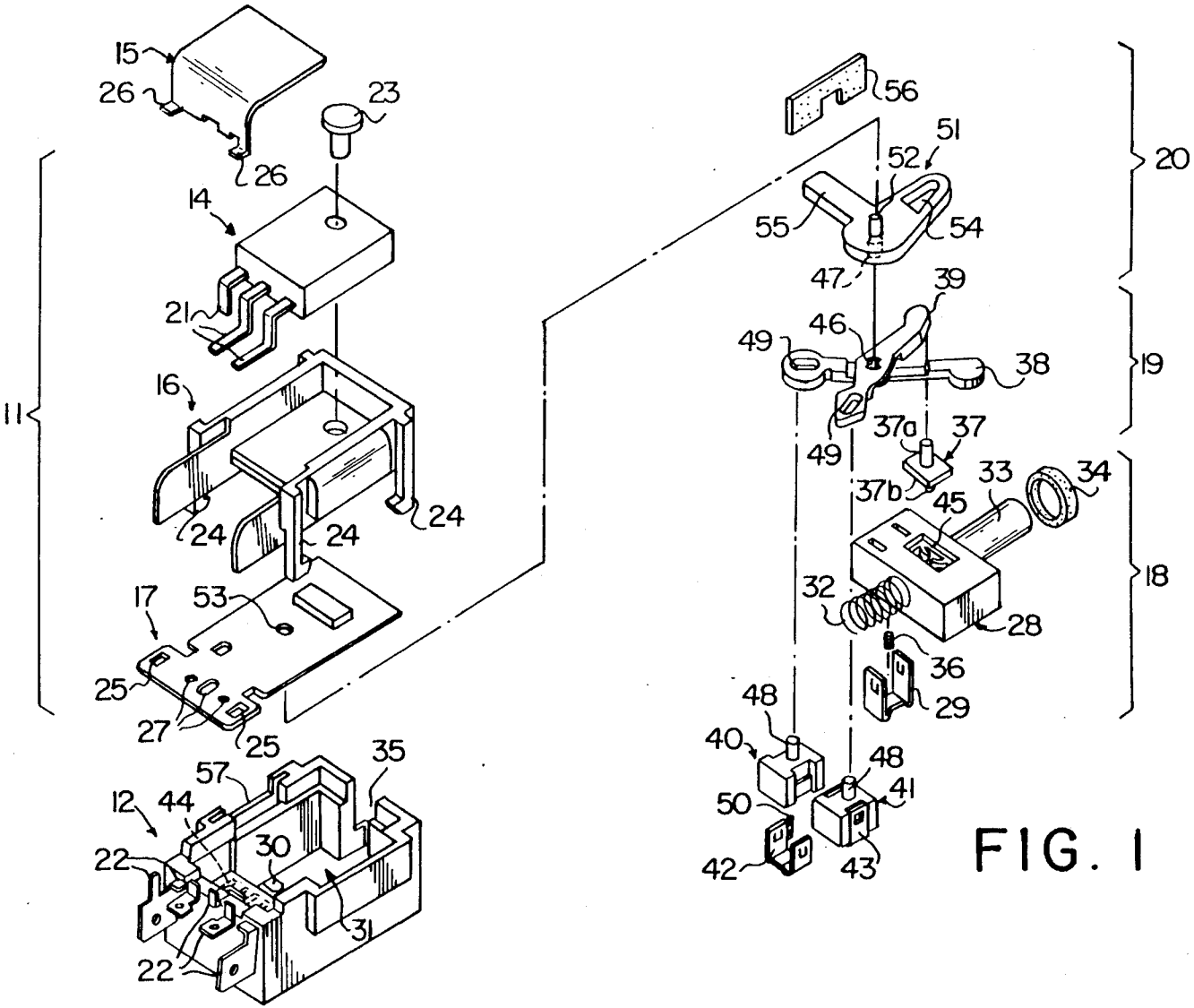
FIG. 1 is an exploded perspective view of a first embodiment of the switch mechanism for a DC power tool according to the present invention.
Figure 2:
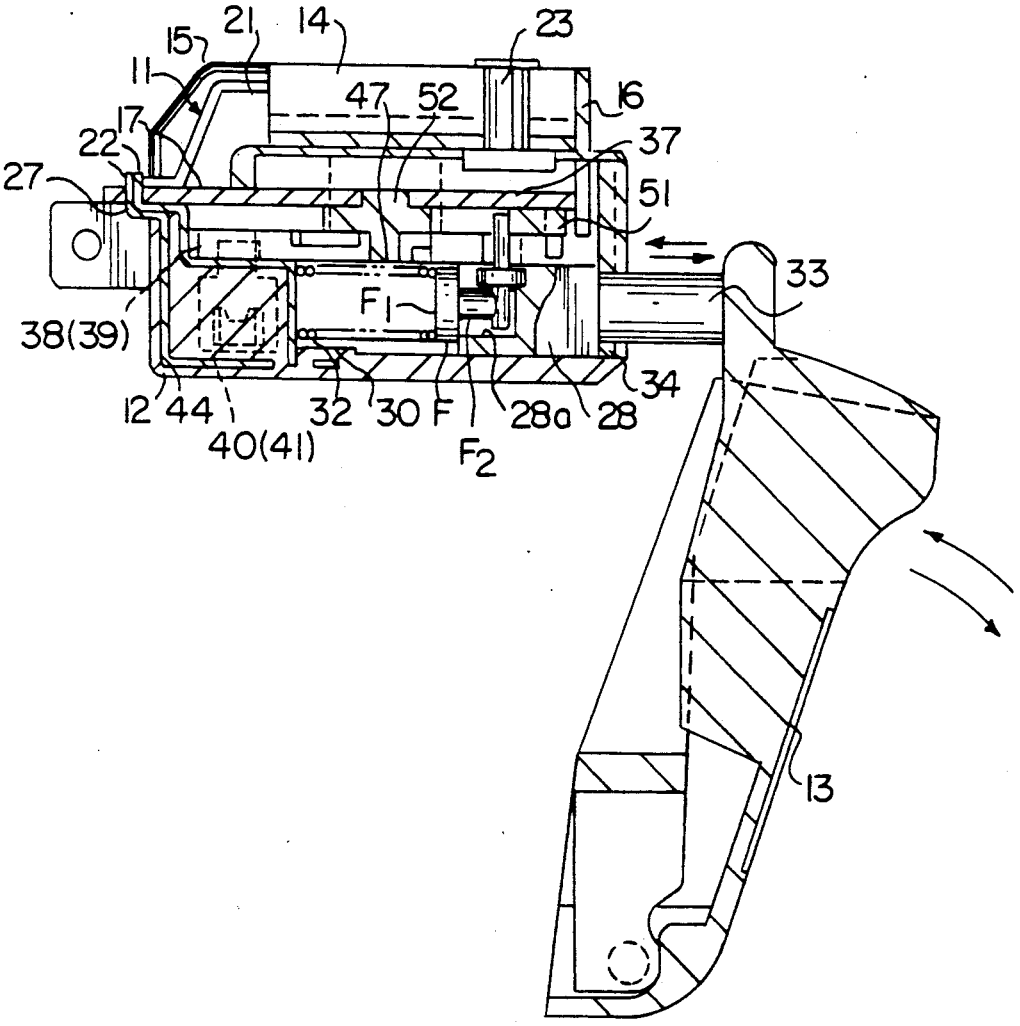
FIG. 2 is a longitudinal sectional view of the switch for a DC power tool.

The drawings generally illustrate a switch for a DC power tool. Referring to FIGS. 1 and 2, this switch for a DC power tool consists of a control circuit unit 11 for a DC motor, a switch case 12 for accommodating and supporting this control circuit unit 11, and an operation lever 13 for activating and controlling the motor, and is incorporated, for instance, in the grip of an electric power tool such as an electric screw driver.

The control circuit unit 11 comprises a power transistor 14, a dust cover 15 for covering the terminal portion of the power transistor 14 from above, a transistor support 16 for supporting the power transistor 14, a printed circuit board 17 for mounting a control circuit thereon, a switching mechanism 18 for turning on and off the motor, a motor output fine control mechanism 19, and a motor rotation reversion switch-over mechanism 20.

The power transistor 14 is rectangular in shape, and turns on and off the power to the armature of the DC motor with its three terminals 21 projecting from a side face thereof bent downward and connected to power and motor terminals 22 which are insert molded in the switch case 12.

The power transistor 14 is mounted and secured on the upper surface of the transistor support 16 by way of a crimped rivet 23. The lower end of the transistor support 16 surrounds the periphery of the printed circuit board 17, and is provided with engagement pawls 24 depending from the four corners therefrom and engaging with the switch case 12.

The printed circuit board 17 is interposed between the transistor support 16 and the switch case 12, and projecting pieces 26 of the dust cover 15 are engaged with engagement holes 25 provided on one side portion of the circuit board 17 for mounting the dust cover 15 on the circuit board 17. To terminal connection holes 27 of the printed circuit board 17 are connected the power and motor terminals 22.

The switching mechanism 18 consists of a linear slider 28, a linearly moveable contact 29 mounted on its lower surface and a front fixed contact 30, and is accommodated in the switch case 12. The linear slider 28 is received in the upper opening 31 of the switch case 12 in a slidable manner along the fore-and-aft direction, and is normally urged into its front position under the spring force of a slider return spring 32 which is interposed between the inner end surface of the linear slider 28 and the inner end surface of the switch case 12, with its depression shaft 33 projecting from the front end surface of the linear slider 28 and protruding forward, under a biasing force, from a front opening 35 of the switch case 12 by way of a front seal member 34 for dust prevention.

The lower surface of the linear slider 28 is provided with an inverted M-shaped linearly moveable contact piece 29 provided with a biasing spring 36 for creating a contact pressure, and this moveable contact piece can move linearly along the bottom surface of the switch case 12. A front fixed contact 30 for switching operation is insert molded in a front part of the bottom surface of the switch case 12 so as to correspond with the linearly moveable contact 29.

An end of the actuation lever 13 opposes the outer end of the depression shaft 33, and a downward stroke of the actuation lever 13 causes the linear slider 28 to be moved linearly against the biasing force of the slider return spring 32 so as to form a slide switch. At the end of the stroke of the actuation lever 13, the linearly moveable contact 29 comes into contact with the front fixed contact 30 and turns on the power to the motor.

The motor output fine control mechanism 19 comprises an actuation pin 37, first and second direction converting levers 38 and 39, first and second lateral sliders 40 and 41, laterally moveable contacts 42 and 43 mounted on the lower surfaces of the lateral sliders 40 and 41, and rear fixed contacts 44, and is accommodated in the switch case 12.

The actuation pin 37 is provided with an upright pin **37*a* on its upper surface, and an engagement projection 37*b* depending from its lower surface and received in an engagement portion 45 permitting a lateral movement of the engagement projection 37*b*. The engagement portion 45 is provided with an irregular shape for producing a resistance to the lateral movement of the actuating pin 37** to give a tactile feel to the operator.

Figure 3:
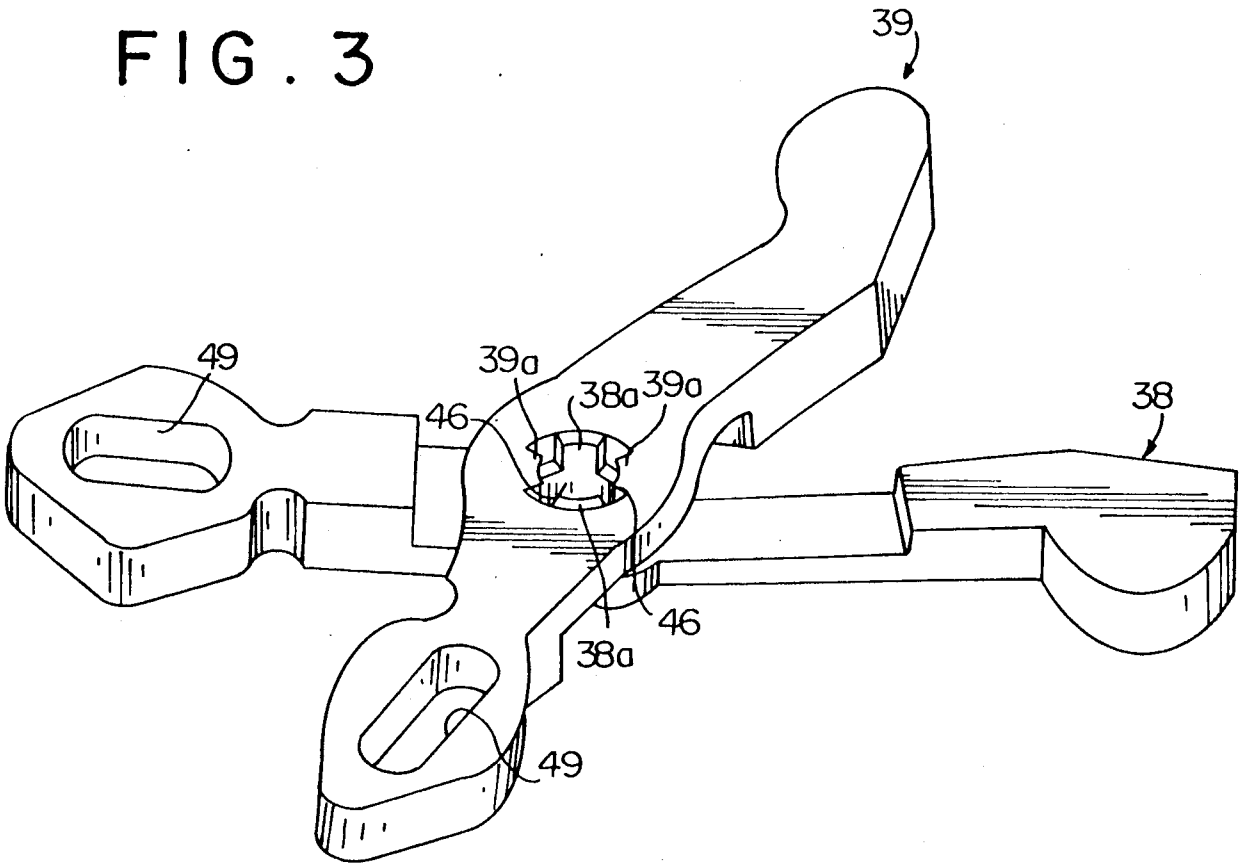
FIG. 3 is an enlarged perspective view of the direction converting levers.

First and second direction converting levers 38 and 39 are crossed to each other in the manner of a pair of scissors, and a common pivot pin 47 is passed through holes 46 at the mutually crossed parts so as to permit pivotal movement of the direction converting levers 38 and 39. As best shown in FIG. 3, the inner circumferential surfaces of the holes 46 of the direction converting levers 38 and 39 are provided with circumferential shoulder surfaces **38*a* and 39*a*** so as to restrict the possible range of mutual angular displacement between the two levers.

The two levers 38 and 39 are disposed above the linear slider 28 in such a manner that the pin **37*a* of the actuating pin 37 is placed between front ends of the levers 38 and 39 so as to oppose them. Therefore, when the linear slider 28 is advanced, the front end of one of the levers 38 is subjected to a pressure in the advancing direction of the actuating pin 37 moving integrally with the linear slider 28, and the rear end portion of the lever 38 is moved laterally as a result of its rotational movement around the pivot point. However, since the other lever 39** does not receive any pressure, it would not be rotated, and remains at its rest position.

To the rear ends of the levers 38 and 39 are attached first and second lateral sliders 40 and 41, respectively.

The lateral sliders 40 and 41 are provided with engagement pins 48 on their upper surfaces so that they may be moved laterally in synchronism with the movement of the levers through engagement between the engagement pins 48 and engagement slots 49 of the rear ends of the levers 38 and 39.

The lower surfaces of the lateral sliders 40 and 41 are provided with inverted M-shaped laterally moveable contacts 42 and 43 by way of biasing springs 50 for creating contact pressure so that these contacts may slide laterally along the inner bottom surface of the switch case 12. A plurality of fixed rear contacts 44 for motor output fine control are insert molded in a rear part of the inner bottom surface of the switch case 12.

In this case, the first lateral slider 40 is assigned for normal rotation while the second lateral slider 41 is assigned for reverse rotation of the motor, and a small motor output can be achieved in an early part of the stroke of the linear slider 28 by establishing electric contact with either one of the laterally moveable contacts 42.

The aforementioned reversion switch over mechanism 20 for the motor includes a reversion switch over lever 51 in the switch case 12 for switch over between normal rotational direction and reverse rotation direction of the motor. This reversion switch over lever 51 is pivotally supported by an upright pin 52 projecting from its upper surface and received by a pivot hole 53 provided in the printed circuit board 17, and the aforementioned common pivot pin 47 depends from the lower surface of the reversion switch over lever 51 in alignment with the upright pin 52. This common pivot pin 47 is passed through the crossing holes 46 of the first and second direction converting levers 38 and 39 for pivotally supporting these levers 38 and 39.

A pin receiving hole 54 provided in an extension of this reversion switch over lever 51 loosely receives the upright pin 37*a* of the actuating pin 37 in a linearly moveable manner so that the lateral movement of the actuating pin 37 resulting from the rocking movement of the switch over lever 51 may select either normal or reverse rotational direction of the motor.

From a lateral side of this reversion switch over lever projects a side lever 55 which projects out of a side opening 57 of the switch case 12 by way of a side seal member 56 for dust prevention so as to permit the rocking actuation of the side lever 55 from outside.

The switch case 12 is constructed as a box having an open top, and fixed contacts 30 and 44 and other power and motor terminals are insert molded in the inner bottom surface of the case, respectively. The switching mechanism 18, the motor output fine control mechanism 19 and the motor reversion switch over mechanism 20 are received in the upper opening 31 of the switch case 12, and the printed circuit board 17, the transistor support 16, the power transistor 14 and the dust cover 15 are mounted thereon.

The switch for a DC power tool having the above described structure is incorporated into the grip of a power tool, and the actuation lever 13 thereof opposing the linear slider 28 is normally in its forwardly rotated position around the pivot portion of the actuation lever and projecting in an oblique fashion which is adapted to be depressed, under the biasing force of the internally incorporated slider return spring 32.

Figure 4:
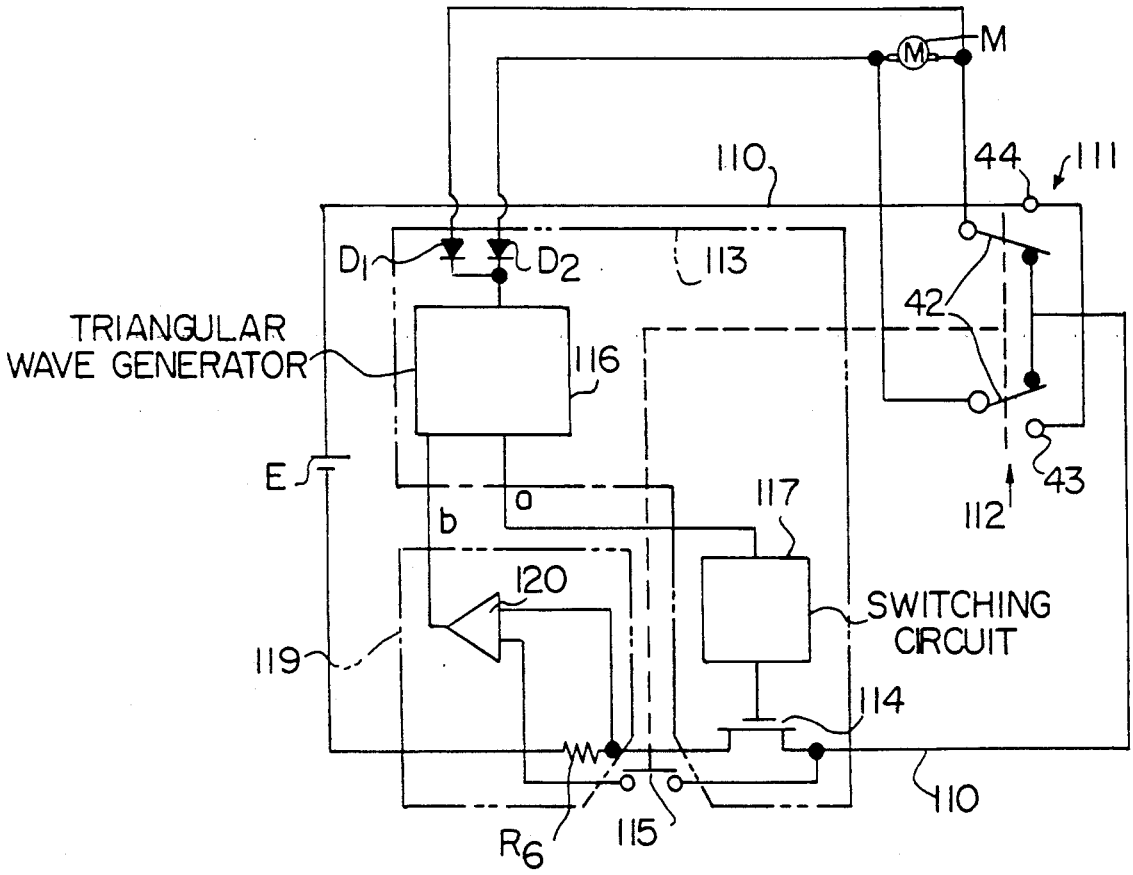
FIG. 4 is a circuit diagram of the motor control circuit to which the present invention was applied.

FIG. 4 is a block diagram of the switch circuit of an electric power tool, and, in FIG. 4, a motor M is connected to a power source E by way of a main circuit 110 which comprises a normal rotation control switch unit 111 and a reverse rotation control unit 112 so that power is supplied to the motor M and the motor is driven in a desired direction by turning on one of the switch units 111 and 112.

The main circuit 110 further comprises an output device 114 forming a part of a low speed control circuit 113 and a shorting switch unit 115 forming a high speed control circuit which are connected in parallel with each other, and the torque output of the motor M is controlled by carrying out a switching control on the output device 114 while the shorting switch unit 115 when it is turned on directly connects the motor M to the power source E so as to drive the motor M at high speed.

The low speed control circuit 113 consists of a triangular wave generating circuit 116, a switching circuit 117, and the aforementioned output device 114. The triangular wave generating circuit 116 is connected to either end of the aforementioned motor M via diodes D1 and D2 which are connected in normal direction.

Normally, since the shorting switch unit 115 is open, and the low speed control circuit 113 is in an operable state, the motor M is driven at low speed in a desired direction by turning on either the normal rotation control switch unit 111 or the reverse rotation control switch unit 112.

When no load is applied to the motor M, the triangular wave generating circuit 116 produces a basic triangular wave, and the switching circuit 117 is activated by the control signal having ON intervals of time duration T1 so as to drive the motor M via the output device 114 accordingly.

When a load is applied to the motor M, since the current flowing through the motor M increases, the increased electric current is detected by the motor current detecting circuit 119 consisting of the resistor R6 and the amplifier circuit 120, and accordingly increases the time duration of each of the ON intervals of the triangular wave generated by the triangular wave generating circuit 116 with the result that the time duration T2 or T3 of each of the ON intervals of the control signal "a" is increased to achieve a high pulse duty condition, and the torque output of the motor M is increased.

Thus, the switching circuit 117 drives the output device 114 with an increased duty ratio in response to the increase in the time duration of the ON intervals. Therefore, when the load of the motor is increased from a state of low speed rotation, the control current of the motor M is automatically increased and its torque output is increased so that a control state equivalent to a continually variable speed control can be obtained.

When a high speed condition is selected, the shorting switch unit 115 is turned on, and the motor M is directly driven by the power source E with the result that a high speed condition is produced. Since such a switch over takes place when the motor torque is high, a shock resulting from the switch over is reduced and a smooth operation is made possible.

It should be understood the switch 115 in FIG. 4 corresponds to the contact set consisting of the contact 29 and the contact 30 in FIG. 1. For more detailed description of the motor control circuit, reference is made to copending U.S. patent application Ser. No. 07/452,748.

Now, when this actuation lever is depressed against the slider return spring, the linear slider 28 cooperating with the lever 13 is slid backward, and this causes the linearly moveable contact 29 achieve a contact with the front fixed contact 30 thereby turning on the power to the motor and rotating it in normal direction.

In this conjunction, by adjusting the depressing stroke of the actuation lever 13, one of the direction converting levers 38 is pressed by the actuation pin 37 at an early part of the depressing stroke thereof, and the lateral slider 40 cooperating with this lever 38 is moved laterally with the result that one of the laterally moveable contacts 42 comes into contact with the rear fixed contact 44 for output control for producing a small output which can increase the work efficiency, for instance, in initially threading a screw.

When the actuation lever is depressed all the way, the maximum torque of the motor is obtained, and a high output can be readily obtained.

When the actuation lever 13 is released, the linear slider 28 returns to its front most position under the biasing force of the slider return spring 32 and turns off the power to the motor.

When the polarity of the motor is to be reversed, the side lever 55 of the reversion switch over lever 51 is moved to another position, and the resulting lateral movement of the actuation pin 37 is transmitted to the front end portion of the other direction converting lever and switches over the polarity of the motor. If the actuation lever is depressed after this switch over is made, the actuation pin 37 then opposes the front end portion of the other direction converting lever by way of the linear slider 28, thereby causing the associated lateral slider to be moved and the associated rotational direction of the motor to be attained while the lateral slider associated with the one direction converting lever would not be moved.

As described above, by laterally moving the lateral slider in synchronism with an early part of the stroke of the linear slider, it is made possible to switch over between the contacts of the two lateral sliders in synchronism with the movement of the linear slider, and the return spring for the lateral sliders can be omitted so that the number of component parts may be reduced, the structure may be simplified, and the assembly work may be facilitated.

Figure 5:
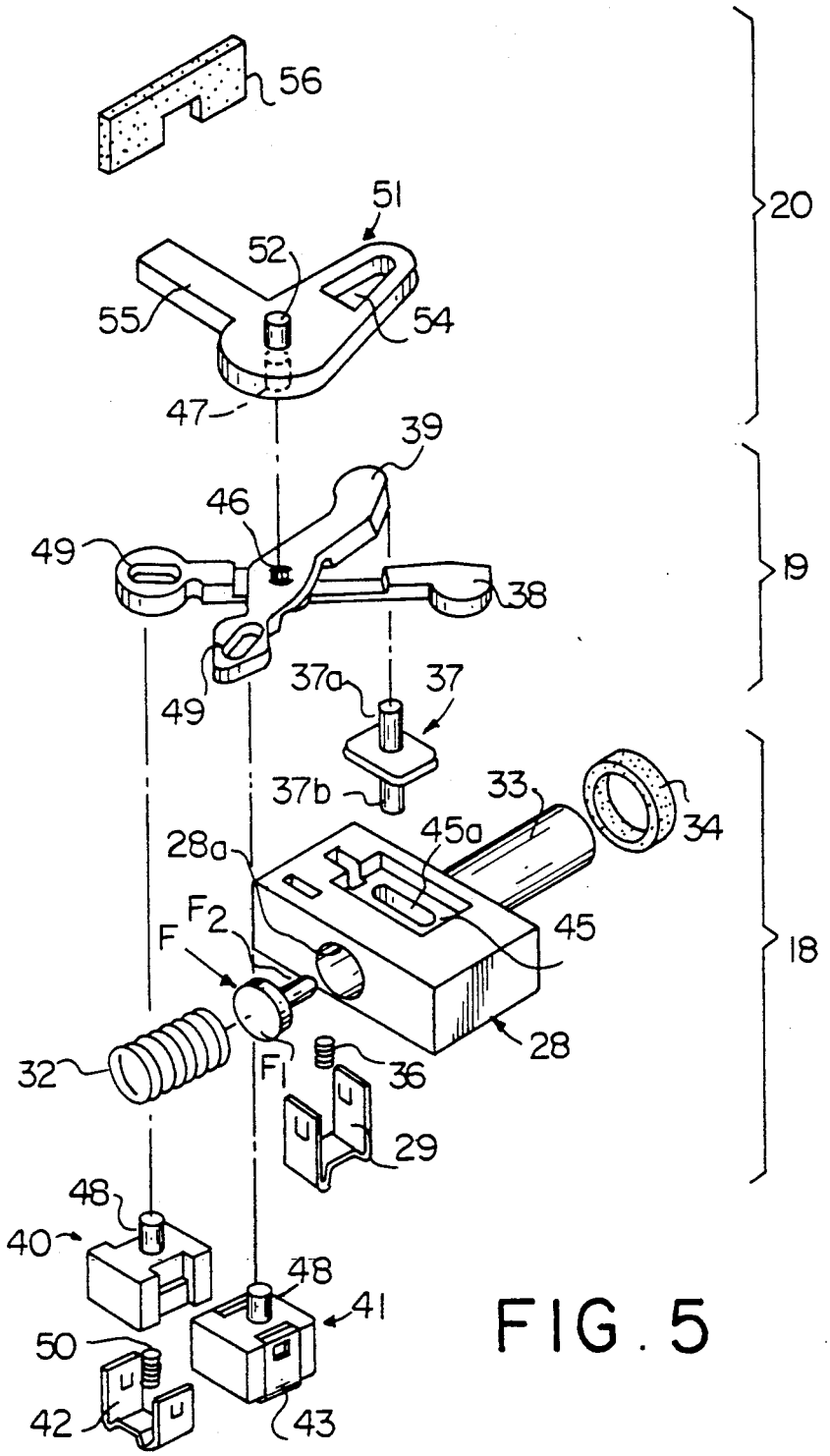
FIG. 5 is a perspective view of a part of a second embodiment of the switch mechanism according to the present invention.

Referring to FIG. 5 showing a second embodiment of the present invention, a biasing force tactile feel piece F is interposed between the opposing surfaces of the linear slider 28 and the slider return spring 32. This biasing force tactile feel piece F is provided with a circular spring seat F1 at its rear end, and a small projection F2 at its front end, and its front end is loosely received in a loose hole 28*a* provided in the opposing surface of the linear slider 28 under the spring force of the slider return spring 32 in such a manner that a tactile feel is given to the actuating pin 37 as a lower pin 37*b* of the actuating pin is engaged by the free end of the small projection F2 as described hereinafter.

The actuation pin 37 is provided with an upright pin 37*a* on its upper surface, and a lower pin 37*b* depending from its lower surface, and the actuating pin 37 is received in a lateral slide slot 45 provided in the upper surface of the linear slider 28 while the lower pin 37*b* is received in a lateral movement permitting slot 45 which communicates with a lower part 45*a* of the lateral slide slot 45. Further, the lower pin 37*b* and the small projection F2 are in mutual engagement at a crossing point of the vertically sunk lateral movement permitting slot 45 and the horizontally sunk loose hole 28*a* in such a manner that the actuating pin 37 is subjected to a change in resistance so as to produce a tactile feel as it is passed laterally against the biasing force interacting between the lower pin 37*b* and the small projection F2.

When the reversion switch over lever 51 is operated, since the actuating pin 37 cooperating therewith by way of one of the direction converting levers is temporarily engaged by the biasing force tactile feel piece F, and the lower pin 37*b* rides over the free end of the small projection F2 thereby creating a sudden change in the biasing force and, hence, the resistance which the reversion switch over lever 51 encounters, the operator of this reversion switch over lever 51 can obtain a clear tactile feel.

As described above, according to this embodiment, since there is a clear tactile feel as the lever is switched over so as to improve the operability and reliability of the reversion switch over lever, and the return spring for the linear slider is utilized for producing this tactile feel so as to achieve an economy of component parts without requiring special elastic members for producing a tactile feel, it is possible to achieve both economy of component parts and improvement in the operability of the reversion switch over lever at the same time.

What we claim is:

1. A reversing switch mechanism for an electric power tool, comprising:

a linear slider received in a switch case so as to be slidable in a first direction along a wall surface of said switch case;

a return spring for urging said linear slider in said first direction;

manual actuating means for manually moving said linear slider against a spring force of said return spring;

an actuating pin carried by said linear slider so as to be moveable along a second direction perpendicular to said first direction;

a pair of direction converting levers crossed in the manner of a pair of scissors by a pivot pin mounted in said switch case, said actuating pin being located adjacent to first ends of said direction converting levers;

a pair of lateral sliders engaged by second ends of said direction converting levers and allowed to move in said second direction along another wall surface of said switch case;

a first contact set including contacts carried by said linear slider and said wall surface of said switch case for mutual cooperation as said linear slider is moved in said first direction; and a second contact set including contacts carried by said lateral sliders and said another wall surface of said switch case for mutual cooperation as said lateral sliders are moved in said second direction;

said actuating pin being moveable between said first ends of said direction converting levers so as to selectively actuate one of said direction converting levers and the associated one of the lateral sliders through movement of said linear slider along said first direction via an engagement between said actuating pin and the first end of the associated one of said direction converting levers.

2. A reversing switch for an electric power tool according to claim 1, wherein said engagement between each of said lateral sliders and the second end of the associated one of said direction converting levers is an engagement between a slot formed in said second end of the associated one of said direction converting levers and a pin carried on each of said lateral sliders.

3. A reversing switch mechanism for an electric power tool according to claim 1, wherein said first contact set comprises contacts for selecting between full power and partial power of an electric motor, and said second contact set comprises contacts for turning on power for said motor and switching over the rotational direction of said motor.

4. A reversing switch mechanism for an electric power tool according to claim 1, wherein said direction converting levers are provided with means for restricting a range of mutual angular displacement.

5. A reversing switch mechanism for an electric power tool according to claim 1, wherein detent means is provided between said actuating pin and said linear slider in order to produce a tactile feel when operating said actuating pin.

6. A reversing switch mechanism for an electric power tool according to claim 5, wherein said detent means comprises a slot for receiving said actuating pin so as to permit its movement in said second direction, a detent member received in a hole communicating with said slot so as to abut said actuating pin at its one end and receive a biasing force from said return spring for said linear slider at its other end, said actuating pin encountering an elastic resistance as it is moved along said slot and rides over said other end of said detent member.

* * * * *